US008790060B2

(12) United States Patent
Müller

(10) Patent No.: US 8,790,060 B2
(45) Date of Patent: Jul. 29, 2014

(54) DEVICE FOR JOINING BOOK BLOCK AND BOOK COVER

(75) Inventor: Markus Müller, Wolfschlugen (DE)

(73) Assignee: Kugler-Womako GmbH, Nuertingen (DE)

( * ) Notice: Subject to any disclaimer, the term of this patent is extended or adjusted under 35 U.S.C. 154(b) by 106 days.

(21) Appl. No.: 13/440,190

(22) Filed: Apr. 5, 2012

(65) Prior Publication Data

US 2012/0308336 A1 Dec. 6, 2012

(30) Foreign Application Priority Data

Apr. 6, 2011 (DE) ..... 10 2011 006 901

(51) Int. Cl.

| | |
|---|---|
| ***B42C 11/00*** | (2006.01) |
| ***B42C 11/02*** | (2006.01) |
| ***B42B 9/00*** | (2006.01) |
| ***B42C 11/04*** | (2006.01) |

(52) U.S. Cl.

USPC ..... 412/19; 412/20; 412/21; 412/4; 412/5

(58) Field of Classification Search

USPC ..... 412/4–5, 19–21

See application file for complete search history.

(56) References Cited

U.S. PATENT DOCUMENTS

| | | | | |
|---|---|---|---|---|
| 3,201,810 | A * | 8/1965 | Throp | 412/21 |
| 5,868,539 | A * | 2/1999 | Rathert | 412/5 |
| 6,497,544 | B1 * | 12/2002 | Schmucker et al. | 412/19 |
| 2010/0310339 | A1 * | 12/2010 | Mueller | 412/19 |
| 2012/0045294 | A1 * | 2/2012 | Friese | 412/5 |

FOREIGN PATENT DOCUMENTS

| | | |
|---|---|---|
| DE | 102880 | 5/1899 |
| DE | 19729529 | 3/1998 |
| DE | 196 39 575 | 4/1998 |
| DE | 19639575 | 4/1998 |

OTHER PUBLICATIONS

German Office action in related application, mail date is Oct. 11, 2012 (with partial English-language translation).

* cited by examiner

*Primary Examiner* — Kyle Grabowski
(74) *Attorney, Agent, or Firm* — Greenblum & Bernstein, P.L.C.

(57) ABSTRACT

Device for joining book block and book cover includes conveyor device, embodied to lift a book block from a lower position into an upper position, and an adhesive application station applying adhesive to the outsides of the book block. Conveyor device and the adhesive application station are arranged so adhesive is applied to the outsides of the book block as it is conveyed by the conveyor device. A removal station is arranged below the adhesive application station and the conveyor device is structured to reverse a direction of movement and to lift and lower the book block and cover in a same vertical plane between the lower position and the upper position. Adhesive application station deactivates adhesive dispensing during the downward movement of the book block with cover.

20 Claims, 5 Drawing Sheets

DEVICE FOR JOINING BOOK BLOCK AND BOOK COVER

CROSS-REFERENCE TO RELATED APPLICATIONS

The present application claims priority under 35 U.S.C. §119 of German Patent Application No. 10 2011 006 901, filed on Apr. 6, 2011, the disclosure of which is expressly incorporated by reference herein in its entirety.

BACKGROUND OF THE INVENTION

1. Field of the Invention

The invention relates to a device for joining book block and book cover, with a conveyor device, which is embodied to lift a book block essentially aligned upright with its spine in front from a lower position into an upper position, an adhesive application station for applying adhesive to the outsides of the book block, wherein the first conveyor device and the adhesive application station are embodied and arranged with respect to one another such that the adhesive application station applies adhesive to the outsides of the book block, while the first conveyor device moves the book block upwards through the adhesive application station, a feeding station, which is embodied to arrange a book cover in a spread out flat form at an angle to the vertical, preferably approximately horizontally, above the adhesive application station and to align it such that the conveyor device moves the book block after leaving the adhesive application station with its spine against the underside of the book cover so that the spine of the book block comes to bear against a center section of the book cover dividing the book cover into two halves, a joining station arranged above the adhesive application station, which is embodied with continued upward movement of the book block by the conveyor device into the upper position to cause an adhesion of the book cover with its two halves on the two sides of the book block and a removal station which is embodied to remove the book block provided with the book cover.

2. Discussion of Background Information

A device of this type can be part of a system for producing photo book blocks or the like, for example. To this end, a material web already previously printed and/or exposed is unwound from a roll, which material web is preferably composed of paper, in particular photo paper or film. Alternatively or additionally the material web unwound from the roll can be printed in a downstream printing station. Printed sheets are subsequently cut off the material web by cross-cutting. The sheets are folded or creased along a fold or crease line, so that the crease line forms a crease edge. In an adhesive application station the creased sheets are provided with adhesive, before they are assembled to form a stack in a stack forming station, in that respectively two adjacent sides of the creased sheets are connected to one another by the adhesive to form a common page. The crease edges of the sheets lying one on top of the other in the stack thereby jointly form the spine of the book block formed from the stack. Subsequently, the book block thus produced is removed from the stack forming station and is transported to a following station for further processing, which contains, among other things the device of the type mentioned at the outset in order to provide the book block with a book cover. The book cover is usually a thicker layer of paper or cardboard.

The joining of book block and book cover is carried out by insertion and adhesion of book block and book cover to one another. This can take place during a vertical conveyor movement in that a book block essentially upright with its spine in front is lifted by the first conveyor device from a lower position into an upper position. Before the actual joining operation the outsides of the book block are provided with adhesive in an adhesive application station, while the book block is moved through the adhesive application station in the upward direction.

Furthermore, the associated book cover is first centered with the back of the book block. This takes place in an alignment station, wherein during this alignment operation the book cover is in a flat spread out form and in an essentially horizontal alignment and is arranged above the adhesive application station. At this stage the book covers are already provided with a centrally arranged pair of crease lines spaced apart from one another, which enclose between them a narrow central section, which forms the book spine of the completed book. With continued vertical conveyor movement, the two halves of the centered book cover are folded in a feeding station against the two outsides of the book block. The two halves of the book cover thus come to bear against the glued outsides of the book block. By pressing the book cover to the book block, an effective adhesion between book cover and book block is achieved.

In DE 196 39 575 A1 a device for joining book block and book cover of the type referenced at the outside is disclosed, in which the conveyor device has so-called saddle sheets, on which respectively one book block is inserted. To this end the book block to be inserted is fed on a guide and removed for the vertical conveyor movement with its spine in front from the saddle sheets. When a saddle sheet is moved into the spine of a book block, this book block is subjected to an upward movement synchronous with the movement of the saddle sheet by guidance into the adhesive application station, where the book block is glued on its outer surfaces. Due to the continued upward movement of the saddle sheet, the book block carried by this saddle sheet with its spine in front travels into the book cover already lying flat ready, which firstly is held down by so-called centering rails. After the shaping of the spine of the book block into the center section of the book cover forming the spine of the subsequent book, the centering rails center the book cover on the book block and hold the book cover and the book block in a desired position aligned to one another until the transfer to pressure rollers, through which a rolling of the book cover onto the glued outer surfaces of the book block and thus an adhesion takes place. The conveyor device of this known device has a continuous conveyor, on which several saddle sheets are suspended and arranged equidistantly from one another. After a book block and a book cover have been joined, the book block provided with the book cover or the book formed by the "pairing" of book block and book cover, is transported by the continuous conveyor over a deflection roller, while it continues to hang on the saddle sheet, and is subsequently stripped off the saddle sheet by an ejection device and placed on a discharge belt.

One problem that occurs frequently relates to cramped space conditions, in which a device of the type mentioned at the outset or a system in which the device of the type mentioned at the outset is a component, is to be installed.

SUMMARY OF THE INVENTION

The object of the invention is therefore to propose a device of the type mentioned at the outset with a compact design.

This object is attained with a device for joining book block and book cover, with a first conveyor device, which is embodied to lift a book block aligned essentially upright with its spine in front from a lower position into an upper position, an adhesive application station for applying adhesive to the outsides of the book block, wherein the first conveyor device and the adhesive application station are embodied and arranged with respect to one another such that the adhesive application station applies adhesive to the outsides of the book block, while the first conveyor device moves the book block upwards through the adhesive application station, a feeding station, which is embodied to arrange a book cover in a spread out flat form at an angle to the vertical, preferably approximately horizontally, above the adhesive application station and to align it such that the first conveyor device moves the book block after it leaves the adhesive application station with its spine against the underside of the book cover so that the spine of the book block bears against a center section of the book cover dividing the book cover into two halves, a joining station arranged above the adhesive application station, which is embodied with continued upward movement of the book block by the first conveyor device into the upper position to effect an adhesion of the book cover with its two halves onto the two sides of the book block, and a removal station, which is embodied to remove the book block provided with the book cover, characterized in that the removal station is arranged below the adhesive application station, the first conveyor device further is embodied to subject the book block provided with the book cover after it reaches the feeding station essentially to a reversal of the direction of movement and to lower it to the removal station essentially along the path already used for the upward movement, and the adhesive application station is further embodied to deactivate the dispensing of adhesive during the downward movement of the book block provided with the book cover.

Accordingly, the device according to the invention is embodied such that the downward movement of the book block provided with the book cover takes place as a backward movement, while the upward movement of the book block is a forward movement. Accordingly, the reversal of the direction of movement is to be understood as a change of the forward movement into the backward movement, in that the book block then already provided with the book cover when it reaches its upper position by forward movement in the upward direction is briefly stopped and subsequently moved downwards again in the opposite direction, without thereby essentially changing its alignment. In contrast to the prior art, thus a continuation of the upward movement, a lateral transport away and a continuous conveying do not take place. Because the first conveyor device according to the invention is embodied such that the upward movement and downward movement of the book block take place essentially along the same path and thus essentially at the same place, in a skillful yet structurally simple manner the installation area of the device can be kept small and the structure thereof can be designed in a compact manner.

Preferred embodiments and further developments of the invention are disclosed in the dependent claims.

The first conveyor device is preferably embodied to raise and lower the book block essentially in the same vertical plane between the lower position and the upper position.

To this end expediently the conveyor device has engagement means supported so they can be lifted and lowered between an upper position and a lower position for an engagement with the book block.

The engagement means can be an essentially upright knife that can be inserted into the book block from below, which preferably engages between the two center pages in the center of the book block. The knife preferably lies essentially in the vertical plane along which it is moved preferably in the upward and downward direction.

A preferred further development of the embodiment previously mentioned is characterized in that the first conveyor device has a knife case, which accommodates the knife in its lower position at least in part, and a second conveyor device is provided and embodied to transport the essentially upright book block preferably approximately in the horizontal direction to the knife case, so that the knife case engages in the book block and the book block comes to rest against the knife case, wherein the free edge of the knife case pointing towards the second conveyor device is tilted with respect to the transport direction of the second conveyor device, preferably with respect to the vertical, in order during the movement of the book block to the knife case to engage in the book block and to thus open it a little for the engagement with the knife. Thus the knife case, which is preferably to be embodied in a particularly narrow manner, is used not only to receive the knife in its lower rest position, but also in a structurally particularly skillful and at the same time effective manner as an insertion aid in order to open the book block a little for the subsequent engagement with the knife.

Preferably, the second conveyor device has a table, which is provided to be transferred from an essentially horizontal position into an essentially vertical position, to accommodate a book block in its horizontal position and to transfer the book block onto the knife case in its essentially vertical position and is arranged in a moveable manner in the direction of the knife case. With the aid of a table of this type in a structurally particularly simple and at the same time effective manner the book block can be set upright in order to be aligned with the knife. Preferably, the table can have at least one stop for aligning the book block, wherein the stop preferably defines a machine zero edge, to which the book block, preferably with its spine, is aligned. Additionally or alternatively, the table can also be provided with engagement means for the detachable fixing of the book block.

Preferably, furthermore a preferably strip-shaped support means is provided, which is embodied to receive the lower edge of the upright book in its lower position and is arranged so it can be lifted with respect to the knife in its lower position. With the aid of a support means of this type, which supports the lower edge of the upright book and thus the side thereof lying opposite with respect to the spine, the book block is already unloaded from the knife by slight lifting with respect to the knife, whereby, for example, in the removal station the book block can be removed more easily from the knife. A liftable support means of this type can also be advantageously used when moving the book block onto the previously mentioned knife case during the transition from the second conveyor device into the first conveyor device, in that it acts in a supporting manner to draw the book block without essential friction over the knife case and subsequently to place it thereon. Accordingly, with the aid of a support means of this type that can be lifted temporarily, possibly only slightly, undesirable marks in the interior of the book block can be avoided.

The removal station can have a gripper moveable essentially horizontally, the gripper jaws of which are embodied for engagement on both sides with a section adjacent to the spine of the book block provided with the book cover. In particular when the book cover is provided with a groove along both outsides of an edge section adjacent to the spine, these grooves can be used advantageously for an engagement by the gripper jaws. With the aid of the gripper not only can the book block then already provided with the book cover be grasped in a structurally particularly simple and at the same time effective manner for removal and transport away, but at the same time a further pressing operation on the book block provided with the book cover can be also applied in the region of the spine.

Preferably, the first conveyor device is further embodied to lower the book block provided with the book cover as far as the lower position, and the removal station is embodied not to remove the book block provided with the book cover until the first conveyor device has lowered the book block provided with the book cover into the lower position. Thus with this embodiment the book block provided with the book cover is removed from the device and transported away in its lower position, where its upward movement started.

A further preferred embodiment of the invention in which the adhesive application station has at least two adhesive application rollers spaced apart from one another, between which the book block is moved by the first conveyor device during the upward movement thereof, is characterized in that the arrangement of the adhesive application rollers is determined such that the book block is moved between them by the first conveyor device also during the downward movement thereof and are supported so they can be brought between an operating position, in which they bear against the sides of the book block moving past during its upward movement for the application of adhesive, and a rest position in which they are at a greater distance from one another than in the operating position and thus at a distance from a book block moving past during its downward movement. With such a design of the adhesive application station with adhesive application rollers spaced apart from one another which are supported so they can be brought between an operating position and a rest position, the fact is taken into account in a particularly advantageous manner that according to the invention the downward movement of the book block then already provided with the book cover takes place essentially along the same path as the upward movement of the book block.

Another preferred embodiment in which the joining station has at least two press-on means spaced apart from one another, which can be brought into contacting engagement with both halves of the book cover for pressing the two halves of the book cover on both sides of the book block, is characterized in that the press-on means are supported so they can be lowered and lifted between an upper position and a lower position. With this embodiment, through the press-on operation with the aid of the press-on means, which surround the book block already provided with the book cover from above and, applying pressure to the book cover, move along it downwards, a better adhesion of the book cover to the book block is effected.

In a further development of this embodiment, the press-on means are embodied such that they come to bear against the book block provided with the book cover when the book block is in its upper position.

Expediently, the press-on means are embodied as press-on rollers, in order to roll accordingly on the outsides of the book cover and to thereby exert a corresponding bearing pressure on the book cover.

Preferably, the joining station furthermore has a preferably strip-shaped die, which can be brought to bear against the spine of the book block provided with the book cover. The use of a die of this type supports a correct joining of book block and book cover and acts in a stabilizing manner during this operation as well as thereafter during the continued movement of the book block then provided with the book cover. By bearing against the spine of the book block then provided with the book cover, the die can also develop a stabilizing effect during the push-on operation.

A further preferred embodiment is characterized in that the removal station has a pressing device preferably acting essentially horizontally, which has at least two press jaws and at least two press strips as well as a drive device, which is embodied and equipped so that the press jaws and the press strips, offset in terms of time with one another, can be brought into engagement on both sides with the book and/or out of engagement with the book.

Finally, a further preferred embodiment is characterized in that the feeding station has a conveyor device for the transport of a book cover and a grooving device, which has at least two groove strips, which can be brought into engagement with the outside of a book cover to emboss corresponding grooves, a counter strip, which can be brought to bear against the inside of the book cover, and a drive device at least for the movement of the counter strip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 4A is shown in perspective view, FIG. 4B is shown in side view according to the view from FIG. 1, and FIG. 4C is shown in plan view according to the view from FIG. 3.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The device shown diagrammatically in the figures is used for joining a book block and a book cover. A device of this type, which alternatively can also be referred to as a book insertion device, is part of an installation for producing books, which can be photo books, for example. To this end a material web already previously printed and/or exposed is unwound from a roll, which material web is preferably composed of paper, in particular photo paper, or film. Alternatively or additionally the material web unwound from the roll can be printed in a downstream printing station. Printed sheets are subsequently cut off the material web by cross-cutting. The sheets are creased or folded along a crease line or fold line so that the crease line forms a crease edge. The creased sheets are provided with adhesive in an adhesive application station, before they are assembled to form a stack in a stack forming station, in that respectively two adjacent sides of the creased sheets are connected to one another by the adhesive to form a common page. The crease edges of the sheets in the stack lying one on top of the other thereby jointly form the book spine of the book block formed from the stack. Subsequently, the book block now formed from the finished stack is removed from the stack forming station and transported to the device discussed here for the joining of book block and book cover.

The structure of the device for joining book block and book cover is described below based on FIGS. 1 through 3 with an explanation of the operating sequence at the same time, as is shown diagrammatically in FIGS. 4A-4C. In the representation of the figures, the paper travel direction or conveyor direction or transport direction and the process direction run from left to right, which is indicated by arrow A.

Figure 1:
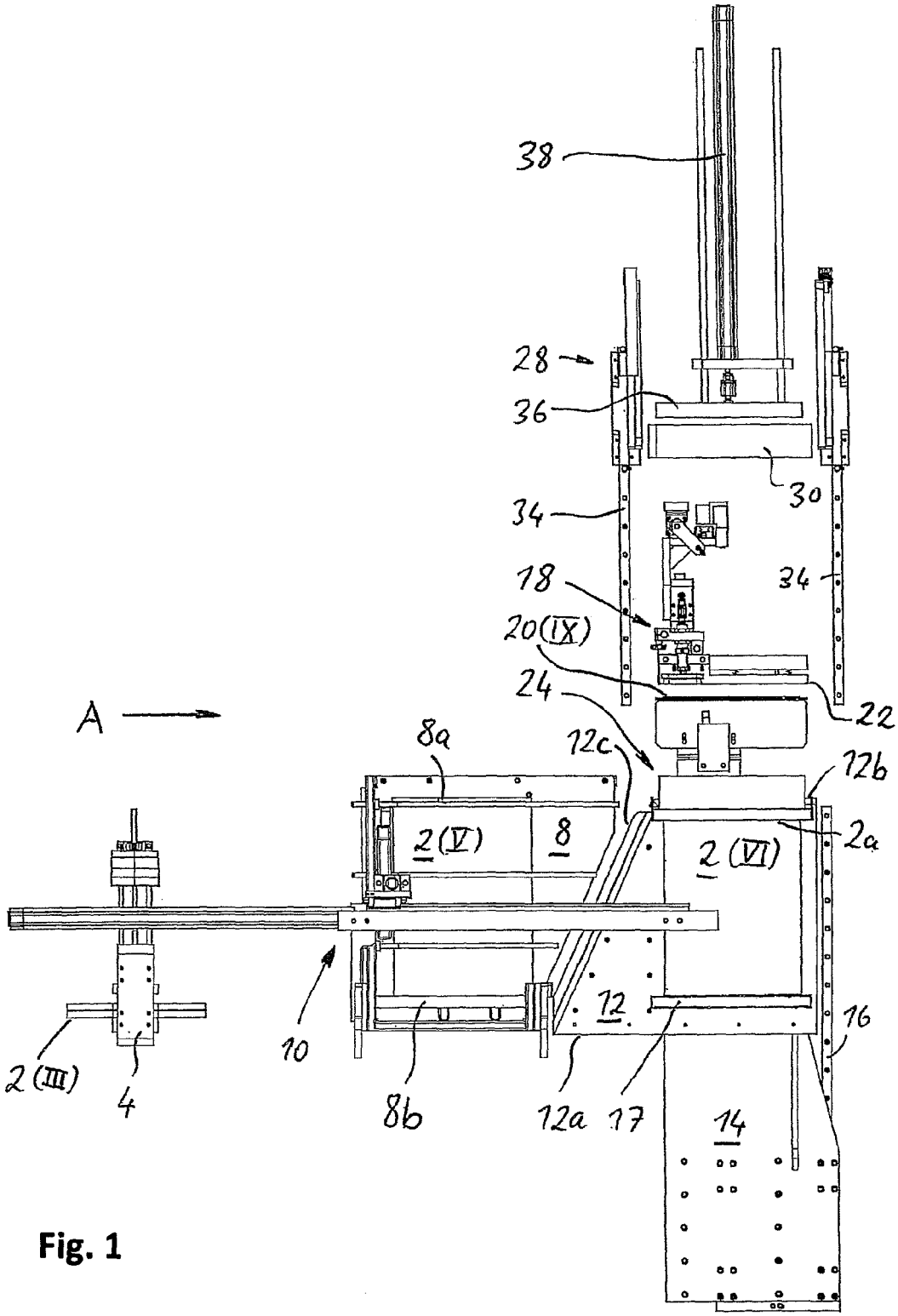
FIG. 1 diagrammatically in side view a device for joining book block and book cover according to a preferred embodiment of the invention.
Figure 3:
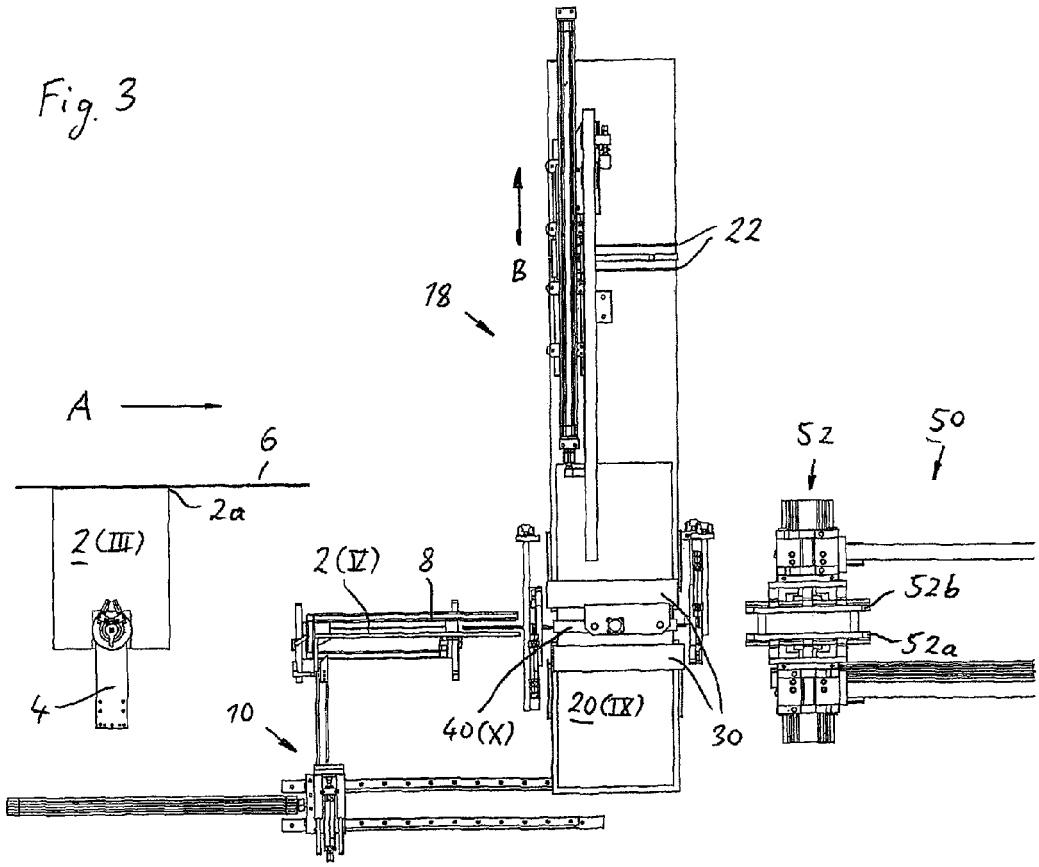
FIG. 3 diagrammatically in plan view the device from FIG. 1.
Figure 4A:
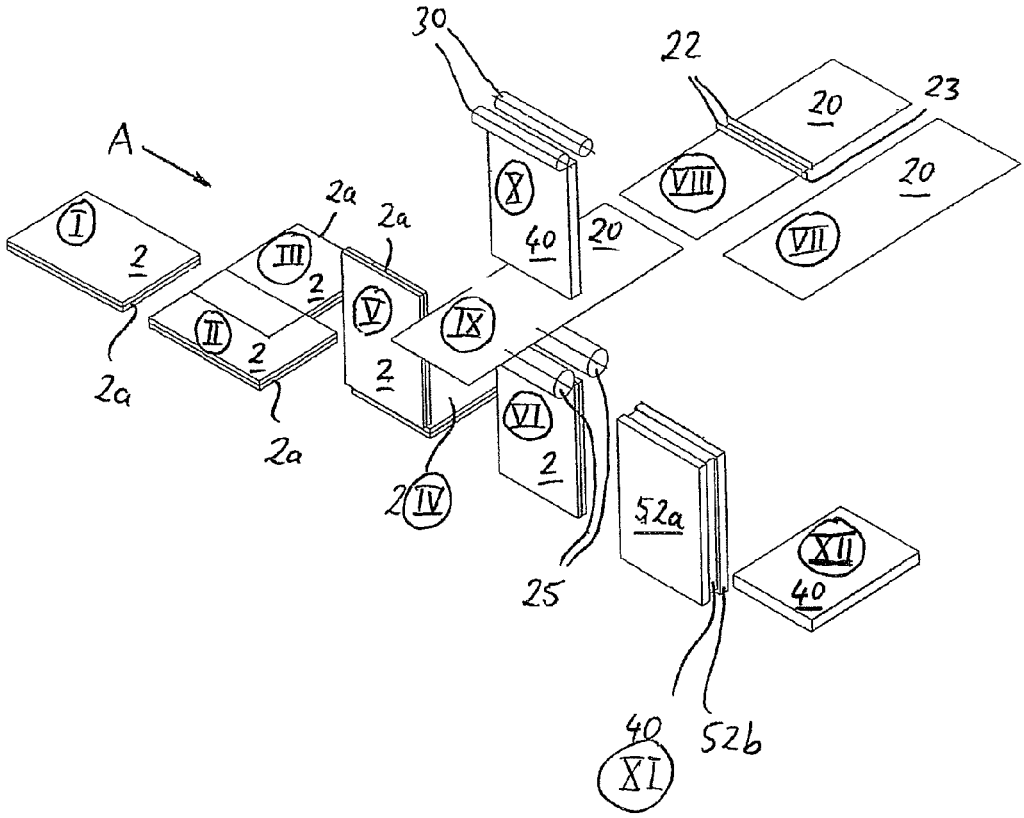
FIGS. 4A-4C illustrate the operating sequence in the device according to the FIGS. 1 through 3 by simultaneous representation of individual operating steps, where
Figure 4B:
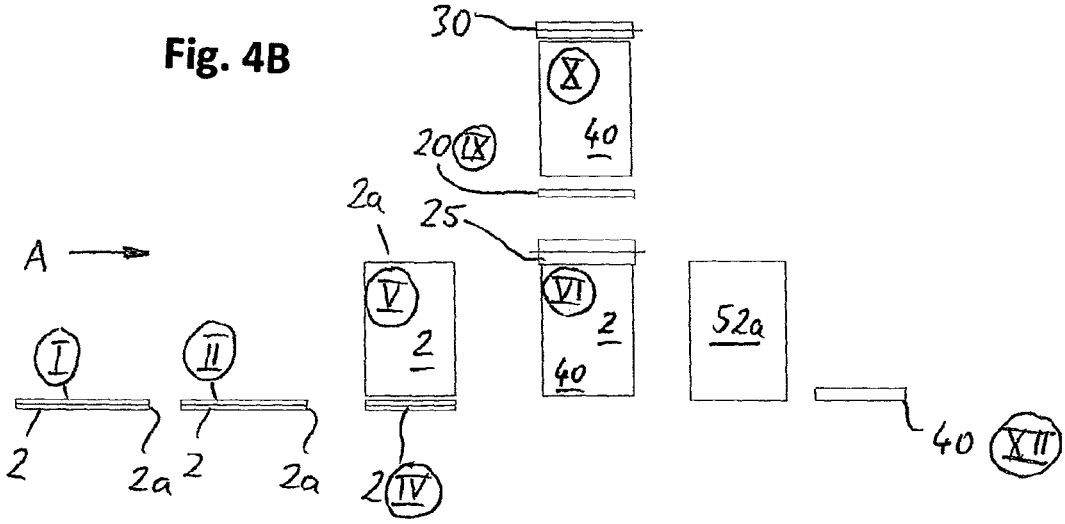
Figure 4C:
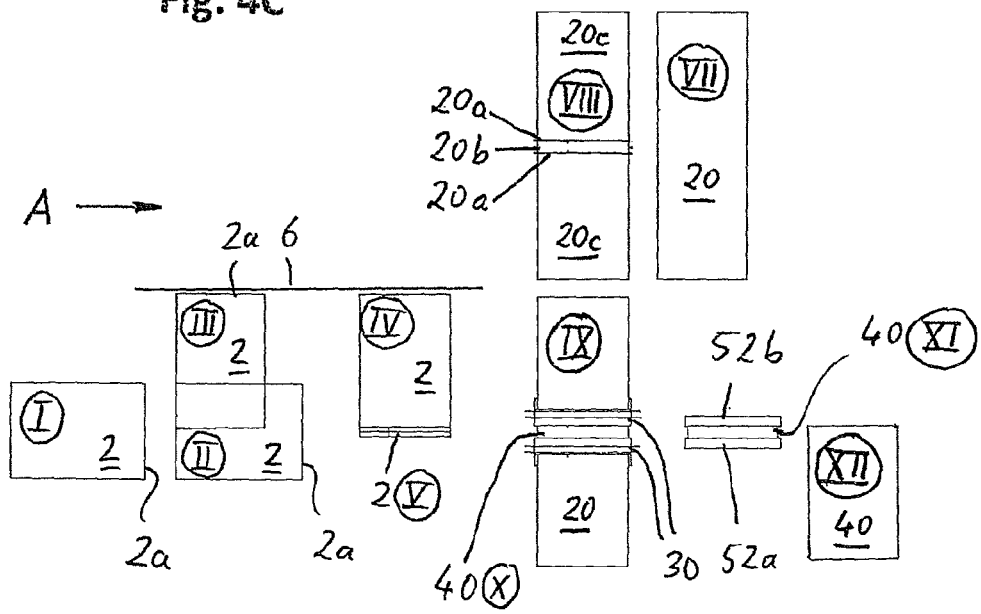

As can be seen in particular from FIGS. 1, 3 and 4, the book blocks labeled by reference number "2" are fed in horizontal alignment thus in a horizontal conveyor plane. Firstly, the book block 2 thereby moves with its spine 2*a* in front, which is formed by the crease lines lying one above the other of the individual layers. This transport condition can be seen in FIGS. 4A-4C based on positions I and II. The transport is carried out by conveyor means, not shown, which can have an endlessly circulating conveyor belt, for example. The book block 2 is transferred to a rotation unit 4, which is shown diagrammatically in FIGS. 1 and 3. The rotation unit 4 grasps the book block 2 in its position II and rotates it by 90° so that it is brought with its spine 2*a* to bear against a bearing edge 6, as can be seen in particular in FIG. 3 as well as based on position III shown in FIGS. 4A and 4C. By means of the bearing against the bearing edge 6, the book block 2 with its spine 2*a* is aligned with respect to a so-called machine zero edge, which is formed by the bearing edge 6 in the exemplary embodiment shown; in this manner it is possible for book blocks with different formats always to be positioned at the same machine zero edge.

In the position III shown in FIGS. 4A and 4C the book block 2 is thus positioned with two of its edges such that only one degree of freedom is available in the transport direction according to arrow A.

The book block 2 is moved along the bearing edge 6 with its spine 2*a* bearing there in the transport direction according to arrow A into the position IV shown in FIGS. 4A-4C. This can be carried out, for example, with the aid of the rotation device 4, if it is supported in a correspondingly displaceable manner. However, alternatively, a slider, not shown in the figures, can also displace the book block 2 accordingly in that the book block 2 in its position III (cf. FIGS. 4A-4C) is detached from the rotation unit 4 and is brought into engagement with the slider.

With the movement into the position IV according to FIGS. 4A-4C, the book block 2 is conveyed onto a mounting table, which at this time is in a horizontal position and subsequently is tipped up by 90° into a vertical alignment. In FIGS. 1 and 3 this mounting table is shown in its already tipped-up upright position and is provided with reference number "8." As FIG. 1 further shows, the mounting table 8 is provided with two lateral strips 8*a*, 8*b*, which extend in the transport direction according to arrow A and are spaced apart from one another. These two lateral strips 8*a*, 8*b* serve as stops at the side edges of a book block 2 taken up from the mounting table 8 in order to fix the book block 2 crosswise to the transport direction according to arrow A. With respect to different widths of the book blocks 2 with different formats, the (lower, according to FIG. 1) lateral strip 8*b* is arranged in a displaceable manner along the surface of the mounting table 8 crosswise to the transport direction according to arrow A. The mounting table 8 is held on a stand 10 in a pivotable manner about a pivot axis (not shown in the figures) adjacent to the lateral strip 8*b*.

The (upper, according to FIG. 1) lateral strip 8*a* is fixed to the mounting table 8 in a stationary manner in the exemplary embodiment shown and arranged and aligned such thereby that it is aligned to the bearing edge 6 shown diagrammatically in FIGS. 3 and 4C or forms a section of the bearing edge 6, when the mounting table 8 is in its horizontal position in which the book block 2 is taken up into the position IV according to FIGS. 4A-4C on the mounting table 8. By tipping up the mounting table into the upright position shown in FIGS. 1 and 3, the book block 2 located on the mounting table 8 is also brought into a vertically upright position, which is labeled by "V" in FIGS. 4A-4C. So that the book block also remains fixed to the mounting table during the pivot movement and in the upright position of the mounting table 8, the mounting table 8 is furthermore provided with locking means or engagement means, not shown in the figures, (for example, in the form of clamps) for the detachable fixing of the book block 2 on the surface of the mounting table 8.

In the exemplary embodiment shown, the mounting table 8 is supported on the stand 10 not only in the pivotable manner previously described, but also in a linear moveable manner in the transport direction according to arrow A, so that it can be pushed in the direction of a knife case 12. This pivot movement and this linear movement are generated by a drive, not shown in the figures. In FIG. 1 the mounting table 8 is shown in a position directly adjacent to the knife case 12. The knife case 12 is a narrow case, which is arranged in an upright or vertical manner and extends parallel to that vertical plane that is spanned by the mounting table 8 in its upright position according to FIG. 1. The knife case 12 is composed essentially of two plates, the small distance from one another thereof is essentially measured so that they can receive a knife 14 between them. The knife 14 is arranged in the same virtual plane as the knife case 12 and supported in a movable manner in the vertical direction along a rail system 16. The lifting and lowering of the knife 14 along the rail system 16 is carried out by a drive, not shown in the figures either. In FIG. 1 the knife 14 is shown in its lower position. So that the knife 14 during its upward and downward movement can run through the knife case 12, the lower edge 12*a* thereof and the upper edge 12*b* thereof are open and form a corresponding slot-shaped opening.

Fingers, not shown in the figures, push the book block 2 from its position V on the mounting table 8 onto the knife case 12 into a position VI. A comparison of the positions V and VI in FIG. 4A shows that they lie in the same virtual plane in which the book block 2 accordingly is pushed in the transport direction according to arrow A onto the knife case 12. The side edge 12*c* of the knife case 12 pointing towards the mounting table 8 thereby grasps in the book block 2 between two book pages in the center thereof, so that the book block comes to rest in position V with its one half on the one side and with its other half on the other side of the knife case 12. In order to avoid damage to the free edges of the book pages by the side edge 12*c* of the knife case 12 pointing towards the mounting table 8 during this push-on movement, this side edge 12*c* of the knife case 12 is embodied in a tilted manner with respect to the vertical in the exemplary embodiment shown according to FIG. 1 in order thus to ensure a gradual and gentle engagement of the knife case 12 with its side edge 12*c* into the book block 2. In order moreover to avoid markings and other damage to the inner pages of the book block in particular in the region of the spine, during the push-on movement the book block 2 is supported not only by the (lower, in the upright position according to FIG. 1) lateral strip 8*b* arranged on the mounting table 8, but also by a strip-shaped support 17, which is arranged on the knife case 12, as FIG. 1 further shows. The support 17 is thereby supported in an adjustable manner in the vertical direction and is adjusted to a height, in which it is aligned with the (lower, in the upright position of the mounting table 8 according to FIG. 1) lateral strip 8*b* of the mounting table 8. The arrangement of the stationary lateral strip 8*a* on the mounting table 8 and the adjustable lateral strip 8*b* on the mounting table 8 and the likewise adjustable support 17 on the knife case 12 is determined such that the book block 2 with its spine 2*a* is pushed onto the knife case 12 at a certain vertical distance from the upper edge 12*b* of the knife case 12, in order to prevent the upper edge 12*b* of the knife case 12 also from causing markings or other damage inside the book block 2. Like the lateral strip 8*b* on the mounting table 8, with a format change the support 17 is also adjusted in the same manner vertically on the knife case 12 at right angles to the transport direction according to arrow A. Preferably, a strip-shaped support according to the support 17 shown in FIG. 1 is provided on each of the two outsides of the knife case 12, wherein both supports are synchronously adjustable in the vertical direction and thereby always lie at the same vertical height.

Furthermore, the arrangement and alignment of the mounting table 8 must be determined in its upright position according to FIG. 1 with respect to the knife case 12 such that the knife case 12 engages with its side edge 12 centrally in the book block 2 when it is pushed onto the knife case 12 from position V into position VI. So that book blocks or books with different thicknesses can be processed, the mounting table 8 is furthermore supported on the stand 10 such that in its upright position according to FIG. 1 it is also additionally adjustable crosswise to the transport direction according to arrow A (and thus crosswise to the drawing plane of FIG. 1). In this manner the last degree of freedom, namely the variance of the thickness of the book block 2, can also be eliminated, since the mounting table 8 carries out a type of averaging, based on the thickness of the book block 2 due to the mentioned crosswise adjustment into its upright position according to FIG. 1.

After the arrangement of the book block 2 in its position VI on the knife case 12, the knife 14 leaves its lower position shown in FIG. 1, moves upwards through the knife case 12 and grasps with its upper edge (not shown in the figures) emerging at the upper edge 12*b* of the knife case 12 into the inside of the spine 2*a* inside the book block 2 in order to carry along the book block 2 accordingly with continued upward movement and thus to lift it in the vertical direction from the knife case 12.

Figure 2:
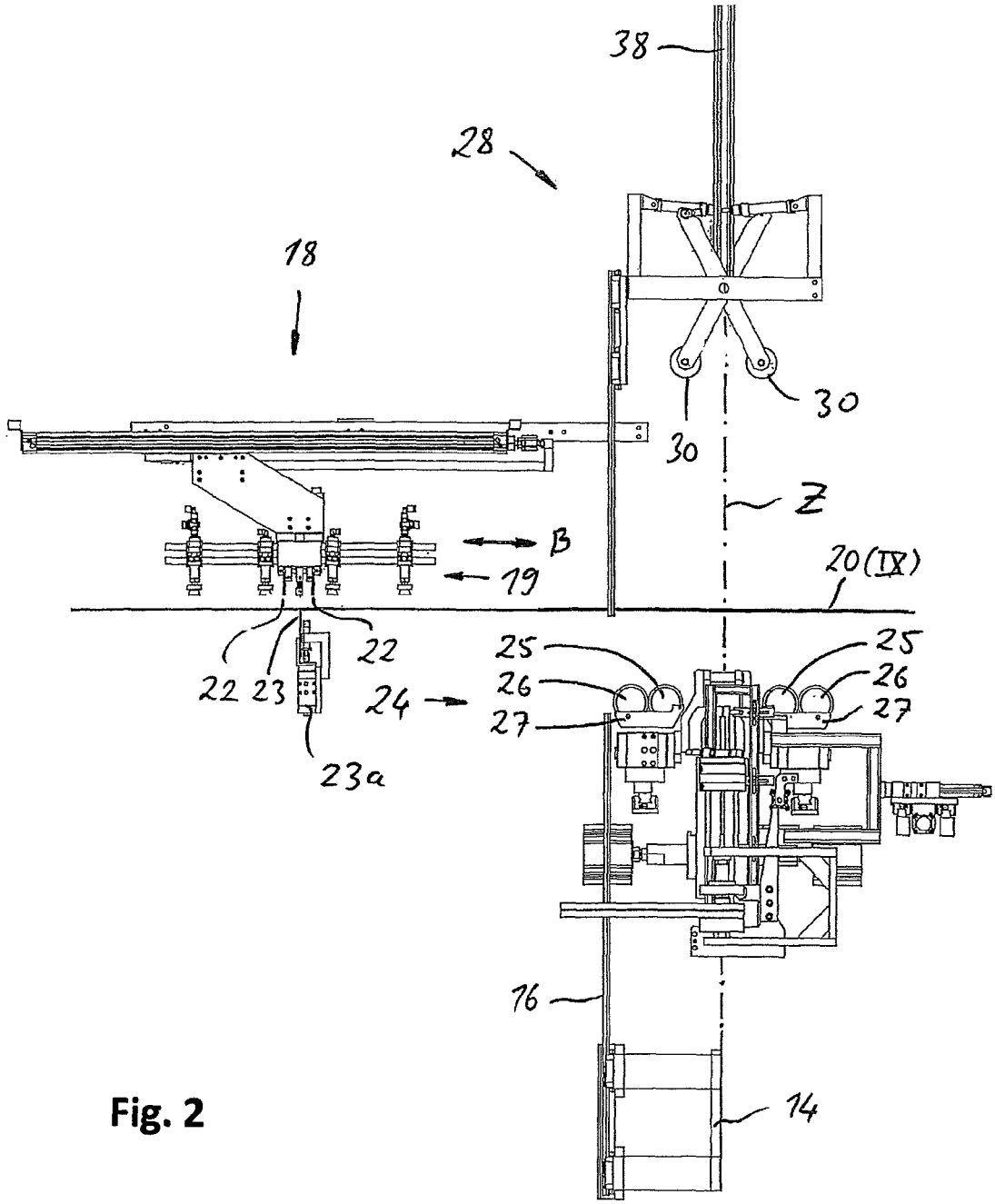
FIG. 2 diagrammatically, the device from FIG. 1 in a side view rotated by 90° with respect to FIG. 1.

As FIGS. 1 through 3 further show, a feeding station 18 is located above the knife case 12, the function of which feeding station is to align and place a book cover accordingly for joining to the book block 2. Book covers of this type are shown in particular in FIGS. 4A-4C and labeled by reference number "20." The delivery of the book covers 20, which takes place essentially simultaneously with the delivery of the book blocks 2, takes place from the side in the exemplary embodiment shown, as positions VII and VIII show, in which respectively a book cover 20 is shown in FIGS. 4A and 4C. During the delivery and in the positions VII and VIII and a shown in FIGS. 4A-4C, the book covers 20, which are preferably composed of cardboard, or at least a thicker paper layer, adopt a form spread out flat. For the transport of the book covers 20, the feeding station 18 has a suction gripper 19 to which respectively a book cover 20 adheres by its top. The suction gripper 19 is reciprocally moveable in a horizontal direction crosswise to the conveyor direction according to arrow A in the direction of the double arrow B shown in FIGS. 2 and 3.

After it has been brought from the delivery position VII into the position VIII by a conveyor device, not shown, the book cover 20 is aligned centrally with respect to two groove strips 22 arranged spaced apart from one another and parallel to one another, which are subsequently pressed into the surface of the book cover 20 in order to form two grooves spaced apart from one another accordingly and running centrally crosswise to the longitudinal extension of the book cover 20. While the groove strips 22 are shown in FIGS. 1, 2, 3 and 4A, the grooves produced thereby are shown indicated in FIG. 4C on the book cover 20 located in position VIII and labeled by reference number "20*a*." As FIG. 4C further shows, the two grooves 20*a* enclose between them a strip-shaped section, which forms the later book spine 20*b*, and divide the book cover 20 otherwise into two halves 20*c*. With these two halves 20*c*, the book cover 20 later comes into joining contact with the outsides of an associated book block 2, which is described in greater detail below. The groove strips 22 are moved and driven by corresponding handling devices, not shown, and together with such handling devices can be part of a grooving station, otherwise not shown in the figures, or of the feeding station 18. As FIGS. 2 and 4A further show, a counter strip 23 is provided under the plane in which the book cover 20 is located in its positions VIII and IX and thus below the book cover 20, while the groove strips 22 are arranged above this plane and thus above the book cover 20. The counter strip 23 extends parallel to the groove strips 22 and lies in the center between them, as can be seen in particular from FIG. 2. The counter strip 23 is lifted and lowered by a lift drive 23*a* and serves on the one hand as a type of abutment with respect to the upper groove strips 22 and on the other hand for embossing a groove, not shown in the drawings, on the inside of the book cover 20 in the center between the two grooves 20*a*. The counter strip 23 and the associated lift drive 23*a* can also be part of a grooving station, not otherwise shown in the figures, or of the feeding station 18. With the aid of the groove strips 22 the grooves 20*a* can be embossed into the book cover 20 in its position VIII according to FIGS. 4A and 4C for the first time or, if corresponding grooves 20*a* have already been produced in the book cover 20 in a preceding operating step, these grooves 20*a* can be emphasized further. The formation or emphasizing of the grooves 20*a* in the book cover 20 is a preparatory measure before the joining of the book block 2 and the associated book cover 20. The grooves 20*a* are used in particular to form a hinge in the manner of a film hinge in the book cover 20 in order to facilitate on the one hand a kinking or folding during the joining and on the other hand the opening and closing of the subsequent book.

As in particular FIGS. 3 and 4A show, the book cover 20 is brought by the feeding station 18 into position IX, in which the book cover 20 is aligned centrally with respect to the book block 2 located in position VI. FIG. 4A further shows that the process steps previously described for the book cover 20 and also the transport thereof from position VII to position IX take place in one plane above a plane in which the book blocks 2 have been conveyed from position I into position VI.

As in particular FIGS. 1 and 2 show, a gluing station 24 is arranged directly above the knife case 12. When now the knife 14 during its upward movement emerges from the upper edge 12*b* of the knife case 12, the book block 2 up to that point still lying in position VI on the knife case 12, is carried along by the knife 14 and lifted accordingly. During this lifting movement, the book block 2 first runs through the gluing station 24 and is glued over the entire surface on its two outsides. The vertical path or the vertical plane, along which the knife 14 moves and carries with it accordingly the book block 2 in the upward direction, is indicated in FIG. 2 by a dot-dashed line labeled by reference character "Z." As in particular FIG. 2 further shows, in the exemplary embodiment shown the gluing station 24 has two arrangements provided on both sides of the conveyor plane or of the conveyor path Z of a glue application roller 25, a further distribution roller 26 in contact therewith and a trough 27 containing glue and accommodating the two rollers 25, 26. Both of these arrangements, or at least the glue application rollers 25 can be brought between an operating position, in which they can be brought into bearing contact for a gluing operation with an outside of a book block 2 running upwards through the gluing station 24, and a rest position in which the two glue application rollers 25 are at a greater distance from one another than in the operating position so that there is no glue application on a book block running through the gluing station 24, in particular in the downward direction.

As can be seen in particular from FIGS. 1 and 2, above the gluing station 24 a so-called joining station 28 is located, into which after leaving the gluing station 24 the book block 2 is moved during its continued upward movement along the vertical conveyor plane or the vertical conveyor path Z. During this continued upward or lifting movement, the book block comes to bear with its forward spine 2*a* against the underside of the center strip-shaped section 20*b* (FIG. 4C) forming the subsequent book spine, of that book cover 20, which is located in particular in the position IX shown in FIGS. 4A and 4C and thus is spread out flat in the horizontal alignment and centered above the gluing station 24 lies centered with respect to the vertical conveyor path or the vertical conveyor plane X. While the book block 2 continues its upward movement, it takes with it the strip-shaped center section 20*b* of the book cover 20, while engagement means, not shown, in the joining station 28 ensure that, with the continued upward movement of the book block 20, the two halves 20*c* (FIG. 4C) of the book cover 20 located in position IX up to this time, are placed against the outsides of the book block 2. The upward movement is continued in the joining station 28 until an upper position is reached, which in FIGS. 4A-4C is given as position X. The feeding station 28 furthermore has two press-on rollers 30 spaced apart from one another, which are arranged vertically via a frame 32 along a rail system 34. Furthermore, a so-called back strip 36 is provided, which is aligned horizontally and is located at the lower end of a guide device 38, as can be seen in particular in FIG. 1. With the aid of the guide device 38, the back strip 36 can be moved in the vertical direction between the two press-on rollers 30. The rail system 34 and the guide device 38 are mounted on a stand, not shown, on which among other things the necessary drives for moving the push-on rollers 30 and the back strip 36 are installed.

FIGS. 1, 2, 4A and 4B show the push-on rollers 30 in their upper position. For a better adhesion of the two halves 20*c* of the book cover 20 to the glued outsides of the book block 2, the push-on rollers 30 are brought to bear against the outsides of the two flipped halves 20*c* of the book cover 20. To this end the two push-on rollers 30 surround from above the book block 2 provided with the book cover 20 and located in its upper position X according to FIGS. 4A and 4B, which book block together with the book cover 20 forms as it were the "book" pair 40 (FIGS. 4A and 4B). During the subsequent vertical downward movement, the two push-on rollers 30 roll along the outside of the book 40 and simultaneously exert pressure on the halves 20*c* of the book cover 20 in order to cause an effective, bubble-free, high-quality adhesion to the book block 2.

The back strip 36 is likewise shown in its upper position in FIG. 1 and can be moved into a lower position with the aid of the guide device 38, in which it comes to bear against the outside of the book cover 20 lying flat in the position IX (FIG. 4A) in the region of the center strip-shaped section 20*b*. During the continued lift or upward movement of the book block 2 in the direction of the upper position X, the back strip 36 is held bearing against the book cover 20 with the aid of the guide device 38 and at the same time guided into the upper position according to FIG. 1. This results in an additional stabilizing effect in order to ensure the joining of the book block 2 to the book cover 20 in the desired alignment.

After the book block 2, now already provided with the book cover 20, has reached the upper position X and also the push-on operation described above with the aid of the push-on rollers 30 has ended, a reversal of direction of movement of the knife 14 takes place, which continues to bear the book block 2 or now in the upper position X the book 40 composed of the book block 2 and the book cover 20 lying above it. The reversal of direction of movement means that in the exemplary embodiment shown the knife 14 is lowered along the same vertical conveyor path or the same vertical conveyor plane Z (FIG. 2). The book 40 thus leaves the joining station 28 backwards, as it were, and also passes backwards through the gluing station 24. During this the push-on rollers 30 of the joining station 28 as well as the glue application rollers 25 of the gluing station 24 are opened, in order not to impede the downward movement and to avoid an undesirable further application of glue.

With the continued lowering or downward movement, the book 40 reaches the lower position VI and is thereby placed again on the knife case 12, now coming from above, while the knife 14 moves further into the knife case 12, until it reaches the lower position shown in FIG. 1. Since in the lower position VI the book bearing on the knife case 12 on both sides now is again supported on its free edge pointing downwards by the support 17 such that the book 40 with its spine does not bear against the upper edge 12*b* of the knife case 12, but is unloaded thereby and thus an engagement of the upper edge 12*b* of the knife case 12 with the interior of the book 40 is ruled out, when the book 40 is removed from the knife case 12 there is no danger either that markings or other damage is caused to the interior of the book 40.

For the removal of the book 40 from the lower position VI a removal station 50 is provided, which is shown diagrammatically in FIG. 3. In the exemplary embodiment shown, the removal station 50 has a gripper 52, which is supported in a moveable manner in the horizontal direction on a frame, not shown, and to which the book 40 hanging in position VI can be moved. With the aid of two gripper jaws 52*a*, 52*b*, adjustable in distance, the gripper 52 grasps the book 40 in the region of its edge section adjacent to the spine and draws the book 40 out of the position VI from the knife case 12 into the position XI, as shown diagrammatically in FIGS. 4A-4C. In addition to the gripper jaws 52*a*, 52*b* shown diagrammatically in FIGS. 3 and 4A-4C, the gripper 52 also has two press strips, not shown in the figures, which are arranged opposite one another above the gripper jaws 52*a*, 52*b*, and are supported in a manner adjustable in distance like the gripper jaws 52*a*, 52*b*. The press strips are used to subject the grooves 20*a* embossed by the groove strips 22 on the outside of the book cover 20 of the now completed book 4 to a post-forming, while the gripper jaws 52*a*, 52*b* ensure not only the necessary engagement for transporting the book 40 away, but also a further stabilization of the completed book 40. For the movement of the gripper jaws 52*a*, 52*b* on the one hand and the press strips on the other hand, a drive device, not shown in the figures either, is provided, which is embodied and aligned such that the gripper jaws 52*a*, 52*b* and the press strips offset in time to one another come into engagement on both sides with the book 40 or out of engagement with the book 40. Concretely, for the engagement with the book 40 firstly the gripper jaws 52*a*, 52*b* are moved against the sides of the book 40 before the press strips come into engagement with the grooves 20*a*. With the detachment of the book 40, the movement sequence takes place in reverse; firstly the press strips and subsequently the gripper jaws 52*a*, 52*b* are brought out of engagement with the book 40.

To transport away to a station, not shown in the figures, for a further aftertreatment, in the exemplary embodiment shown the book 40 is brought into a horizontal alignment according to position XII. The gripper 50 can be used for this purpose. Alternatively, it is also conceivable however after detaching the gripper 50 from the book 40, to transfer the book 40 to a further conveyor device, not shown, which brings the book 40 into the horizontal position XII and transports it away.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for joining book block and book cover, comprising:

a first conveyor device, which is embodied to lift a book block essentially aligned upright with its spine in front in a direction of movement from a lower position into an upper position;

an adhesive application station for applying adhesive to the outsides of the book block, wherein the first conveyor device and the adhesive application station are embodied and arranged with respect to one another such that the adhesive application station applies adhesive to the outsides of the book block, while the first conveyor device moves the book block upwards through the adhesive application station;

a feeding station, which is structured and arranged to arrange a book cover in a spread out flat form at an angle to the vertical above the adhesive application station and to align it such that the first conveyor device moves the book block after leaving the adhesive application station with its spine against the underside of the book cover so that the spine of the book block comes to bear against a center section of the book cover dividing the book cover into two halves;

a joining station arranged above the adhesive application station, which is embodied with continued upward movement of the book block by the first conveyor device into the upper position to cause an adhesion of the book cover with its two halves on the two sides of the book block; and a removal station which is embodied to remove the book block provided with the book cover, wherein the removal station is arranged below the adhesive application station, wherein the first conveyor device is further embodied to subject the book block provided with the book cover, after it reaches the joining station, essentially to a reversal of the direction of movement and to lower the book block essentially in the same vertical plane to the lower position from the upper position, and wherein the adhesive application station is further embodied to deactivate the dispensing of adhesive during the downward movement of the book block provided with the book cover.

2. The device according to claim 1, wherein the first conveyor device comprises an engager that is supported so that it can be lifted and lowered between an upper position and a lower position for an engagement with the book block.

3. The device according to claim 2, wherein the engager is an essentially upright knife that is insertable into the book block from below, and lies essentially in the vertical plane.

4. The device according to claim 3, wherein the first conveyor device comprises a knife case, that receives the knife in its lower position at least in part, and a second conveyor device is provided and embodied to transport the essentially upright book block to the knife case, so that the knife case engages in the book block and the book block comes to rest on the knife case, wherein a free edge of the knife case pointing towards the second conveyor device is tilted with respect to the transport direction of the second conveyor device, in order during the movement of the book block onto the knife case to engage in the book block and to thus open the book block a little for the engagement with the knife.

5. The device according to claim 3, further comprising a strip-shaped support, which is embodied to receive the lower edge of the upright book in its lower position and is arranged so it can be lifted with respect to the knife in its lower position.

6. The device according to claim 4, wherein the second conveyor device comprises a table, which is provided to be transferred from an essentially horizontal position into an essentially vertical position, to accommodate a book block in its horizontal position and to transfer the book block onto the knife case in its essentially vertical position and is arranged in a moveable manner in the direction of the knife case.

7. The device according to claim 4, wherein second conveyor device is provided and embodied to transport the essentially upright book block approximately in the horizontal direction to the knife case.

8. The device according to claim 4, wherein the free edge of the knife case is tilted with respect to the vertical.

9. The device according to claim 6, wherein the table comprises at least one stop for aligning the book block and/or an engager for the detachable fixing of the book block.

10. The device according to claim 1, wherein the removal station comprises a gripper moveable essentially horizontally, the gripper jaws of which are embodied for engagement on both sides with a section adjacent to the spine of the book block provided with the book cover.

11. The device according to claim 1, wherein the first conveyor device furthermore is structured and arranged to lower the book block provided with the book cover as far as the lower position and the removal station is structured and arranged so as not to remove the book block provided with the book cover until the first conveyor device has lowered the book block provided with the book cover essentially into the lower position.

12. The device according to claim 1, in which the adhesive application station comprises at least two adhesive application rollers spaced apart from one another, between which the book block is moved by the first conveyor device during the upward movement thereof, wherein the arrangement of the adhesive application rollers is determined such that the book block is moved between the adhesive application rollers by the first conveyor device also during the downward movement thereof and are supported so the adhesive application rollers can be brought between an operating position, in which the adhesive application rollers bear against the sides of the book block moving past during its upward movement for the application of adhesive, and a rest position in which the adhesive application rollers are at a greater distance from one another than in the operating position and thus at a distance from the book block moving past during its downward movement.

13. The device according to claim 1, in which the joining station comprises at least two pushers spaced apart from one another, which can be brought into contacting engagement with both halves of the book cover for pressing the two halves of the book cover onto both sides of the book block, wherein the pushers are supported so they can be lowered and lifted between an upper position and a lower position.

14. The device according to claim 13, wherein the pushers are structured and arranged such that they come to bear against the book block provided with the book cover, when the book block provided with the book cover is in the upper position.

15. The device according to claim 13, wherein the pushers are push-on rollers.

16. The device according to claim 1, wherein the joining station comprises a strip-shaped die, which can be brought to bear against the spine of the book block provided with the book cover.

17. The device according to claim 1, wherein the removal station comprises a pressing device which has at least two press jaws and at least two press strips, as well as a drive device, which is embodied and equipped so that the press jaws and the press strips, offset in terms of time with one another, can be brought into engagement on both sides with the book and/or out of engagement with the book.

18. The device according to claim 17, wherein the pressing device acts essentially horizontally.

19. The device according to claim 1, wherein the feeding station comprises:

a conveyor device for the transport of a book cover;

a grooving device, which has at least two groove strips, which can be brought into engagement with the outside of a book cover to emboss corresponding grooves;

a counter strip, which can be brought to bear against the inside of the book cover; and a drive device at least for the movement of the counter strip.

20. The device according to claim 1, wherein the angle to the vertical is approximately horizontal.

* * * * *